US005838352A

United States Patent [19]

Martinez

[11] Patent Number: 5,838,352

[45] Date of Patent: Nov. 17, 1998

[54] INK CARTRIDGE REFILLING DEVICE AND STATION FOR CARTRIDGES AND GRAVITY FEED INK BOTTLE

[75] Inventor: Phillip M. Martinez, Groton, N.Y.

[73] Assignee: Smith Corona Corporation, Cortland, N.Y.

[21] Appl. No.: 562,474

[22] Filed: Nov. 24, 1995

[51] Int. Cl.[6] ..... B41J 2/175

[52] U.S. Cl. ..... 347/87; 347/85; 141/375

[58] Field of Search ..... 347/84, 85, 87; 411/387; 53/468; 141/375, 386

[56] References Cited

U.S. PATENT DOCUMENTS

| | | | |
|---|---|---|---|
| 2,392,059 | 1/1946 | O'Neil | 137/318 |
| 4,053,901 | 10/1977 | Skafvenstedt et al. | 347/85 |
| 4,617,692 | 10/1986 | Bond et al. | 411/387 |
| 5,373,936 | 12/1994 | Kawai et al. | 347/86 |
| 5,400,573 | 3/1995 | Crystal et al. . | |
| 5,488,400 | 1/1996 | Crystal et al. . | |
| 5,531,055 | 7/1996 | Sell et al. . | |
| 5,546,830 | 8/1996 | Yuen | 81/3.39 |
| 5,581,287 | 12/1996 | Baezner et al. . | |
| 5,595,223 | 1/1997 | Hayao . | |
| 5,596,358 | 1/1997 | Hunt et al. | 347/85 |
| 5,607,003 | 3/1997 | Gray | 347/85 |

FOREIGN PATENT DOCUMENTS

| | | |
|---|---|---|
| 568124A1 | 11/1993 | European Pat. Off. . |
| WO92/20577 | 11/1992 | WIPO . |
| WO95/18049 | 7/1995 | WIPO . |

OTHER PUBLICATIONS

Advertisement, "Kleanhands Inkjet Storage Station".

Advertisement, "The many benefits of Nu–Kote inkjet refills".

J. Packaging for "Reink Superior Refilling System for Ink Jet Cartridges".

Pelikan, Inc. ink jet refill instructions.

"Refill Instructions" for Parana refill kit.

*Primary Examiner*—Stuart N. Hecker

*Attorney, Agent, or Firm*—Milton Wolson

[57] ABSTRACT

A device for piercing holes in an ink cartridge to enable ink to be inserted therein and an ink cartridge station for securing cartridges of two or more sizes so that the cartridges may be pierced and/or stored therein.

40 Claims, 10 Drawing Sheets

17
118
100
104
100
58
60
2
59
98
105
66
72
54
56

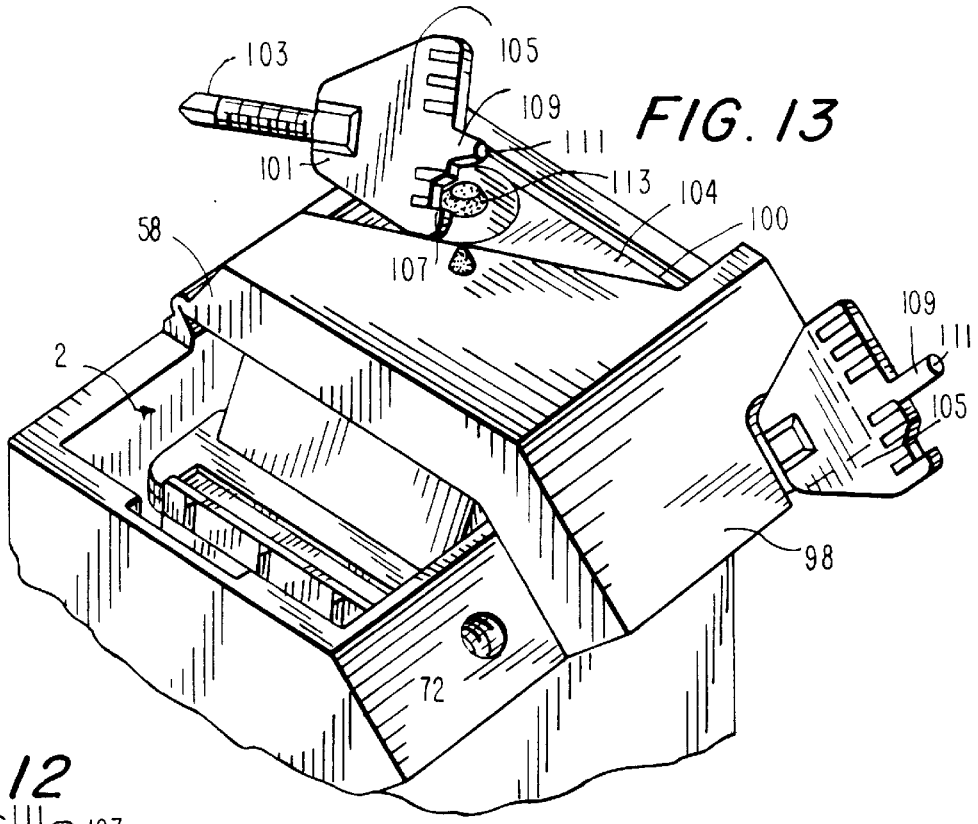
FIG. 13
FIG. 12
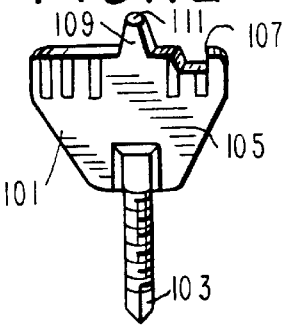
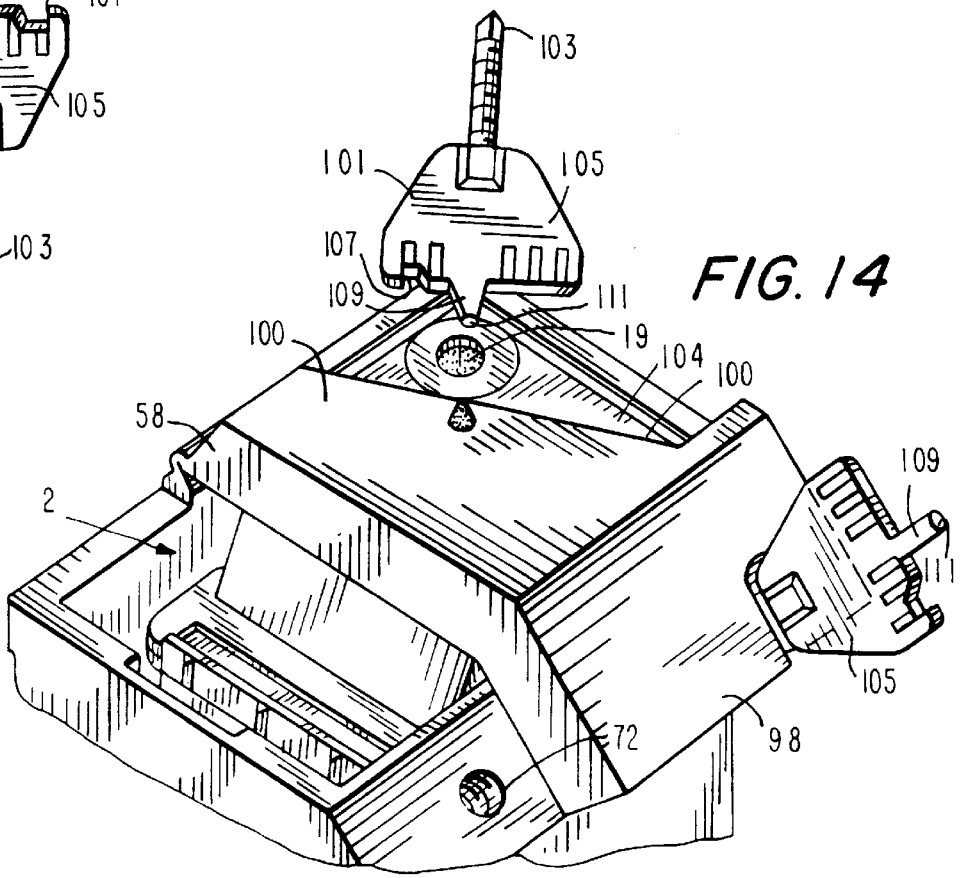
FIG. 14

58A
2
54A
114
108
110
59A
112

112
108
110
58A
2
54A
114
59A

INK CARTRIDGE REFILLING DEVICE AND STATION FOR CARTRIDGES AND GRAVITY FEED INK BOTTLE

BACKGROUND OF THE INVENTION

1. Field of the Invention

The present invention relates generally to a convenient and simple device for accurately piercing holes in an ink jet printer ink cartridge to enable ink to be inserted therein, an ink cartridge station for securing cartridges of two or more sizes so that the cartridges may be refilled or stored therein, and gravity feed ink bottle.

2. Description of the Prior Art

Ink cartridges for use with ink jet printers are well known. Such ink cartridges typically comprise a chamber or chambers in which the ink is housed and may also include an ink jet print head. Multiple chambers may be included in the cartridge to hold ink of different colors for colored printing. It is usual for a single chamber cartridge to include a single color ink, such as black, and for a multiple chamber cartridge used in color printing to include three inks each of a separate primary color, such as cyan, magenta and yellow, in each chamber. During the printing operation, the ink is ejected from the cartridge through the print head to form images on paper.

It has been found desirable to refill such ink cartridges with ink after the ink in such cartridges is expended in order to avoid having to replace the cartridge and the relatively expensive print head, and other electronic components incorporated therein, each time the ink in the cartridge is expended. Additionally, refilling cartridges reduces the number of used cartridges that must be discarded.

One such device for refilling a cartridge is the sidecap refilling guide, which is included in an ink jet refill kit sold by Renewal Resources, under the product number H 40400. This device is designed to make holes in a three chamber color cartridge used in the Hewlett Packard Deskjet family of printers. The sidecap refilling guide is part of a housing that surrounds the periphery of the cartridge and one surface of the guide includes three hubs having openings extending therethrough. The openings, which serve as guides for a drill bit, are located adjacent to one side of the cartridge at the points where the holes in the cartridge for inserting the ink are to be drilled. The drill bit is positioned in the hub and a hole is drilled at the desired location. It is noted that such cartridges will often be refilled in an office, and although simple devices such as screwdrivers are likely to be found in offices, it is not customary for a drill and drill bit to be used in an office. Therefore, suppliers of refilling devices have included a drill bit supplied with a knob attached for manual drilling of the refill holes. The task is, however, physically tiring to the user, as the drill bit must be simultaneously twisted and pushed in order to produce a hole.

When making such a hole in a cartridge for insertion of ink, it has been found desirable to stabilize the cartridge in a holder or station. An example of such a station is that sold by Graphic Utilities, Inc. under the trademark "Klean-hands". Some stations of this type are also useful for storing the cartridges when they are not in use. In the past, stations utilized for refilling and storing cartridges have typically been able to accommodate only a single size cartridge. It is not uncommon, however, for the same ink jet printer to be capable of using both a smaller cartridge, for example, a cartridge having one chamber for black ink, and a larger cartridge, for example, a cartridge having three chambers for colored ink. In such a circumstance, the consumer would be required to use two stations; one to accommodate the smaller cartridge and the other to accommodate the larger cartridge.

Gravity feed ink bottles are known in which ink contained in a bottle is poured into an ink cartridge for use in ink jet printers. The ink bottle is typically inverted and the ink exits an opening in the bottle and enters an opening in the cartridge. In one such arrangement, the aforementioned opening in the bottle is covered by a rubber seal, which is pierced by a hypodermic tube on a hinged cover of a station in which the cartridge is housed. The ink in the bottle then exits the bottle into the opening in the cartridge. Certain such prior art bottles also included a removable cap covering a second opening. After the bottle was inserted into the cartridge, the cap was removed to allow air to enter the bottle and facilitate the exiting of the ink from the bottle. It has been found, however, that, if, after the cartridge has been filled, the bottle is removed from the cartridge without the removable cap being secured to the bottle, the remaining ink in the bottle will have a tendency to flow from the bottle.

SUMMARY OF THE INVENTION

The present invention comprises an improved device for accurately and simply piercing a hole or holes in a cartridge to enable ink to be inserted therein and a station for stabilizing cartridges of two or more sizes while holes are being made in the cartridges. A guide is utilized for making holes at the desired positions in the cartridge which is part of the station surrounding the periphery of the cartridge. The guide is provided with pre-tapped holes which accept a wing screw having a drill point thereon for making a hole in the cartridge. The screw is manually turned through the guide by an easily performed twisting motion and the pre-tapped holes in the guide direct the screw in the desired direction. As the screw continues to be turned the drill bit pierces the hole at the desired location with only a slight amount of force. An improved gravity fed ink bottle is also disclosed which inhibits the tendency of the ink to flow from the bottle after the cartridge has been filled.

Accordingly, it is an object of this invention to provide a convenient and simple guide for accurately making a hole or holes in a cartridge in which ink is to be inserted.

It is a further object of this invention to provide a station for stabilizing an ink cartridge when a hole is being made therein for refilling the cartridge.

It is an additional object of this invention to provide a station for housing an ink cartridge when the cartridge is not in use.

It is a still further object of this invention to provide a station for housing an ink cartridge, wherein the station includes having one or more sealing pads for supporting a print head on the ink cartridge.

It is a still further object of this invention to provide a station for housing an ink cartridge, wherein the station includes an aspiration hole sealing plug.

It is an additional object of this invention to provide a station for housing an ink cartridge, wherein the station includes an air priming hole sealing plug.

It is a still further object of this invention to provide a screw and drill bit combination tool which may also have finger grasping wings for improved ease in producing ink insertion holes in an ink cartridge.

It is an additional object of this invention to provide a screw and drill bit combination tool which also includes an ink sealing ball pusher.

It is a further object of this invention to provide a screw and drill bit combination tool which also includes an ink sealing plug lifter.

It is a still further object of this invention to provide a station to accommodate cartridges of two or more sizes.

It is an additional object of this invention to provide a gravity feed ink bottle in which the tendency of the ink to flow from the bottle after the cartridge has been filled is inhibited.

These and other objects and attendant advantages of this invention will be readily appreciated as the same become better understood by references to the following detailed description when considered in connection with the accompanying drawing in which like reference numerals designate like parts throughout the figures thereof.

BRIEF DESCRIPTION OF THE DRAWINGS

FIG. 12 is a perspective view of the screw and drill bit tool including the ink sealing ball pusher and ink sealing plug lifter;

FIG. 13 is a partial perspective view of the combined refilling device and station showing the use of the sealing plug lifter;

FIG. 14 is a partial perspective view of the combined refilling device and station showing the use of the ink sealing ball pusher;

DETAILED DESCRIPTION OF THE PREFERRED EMBODIMENT

A. The Single Chamber Ink Cartridge

Figure 1:
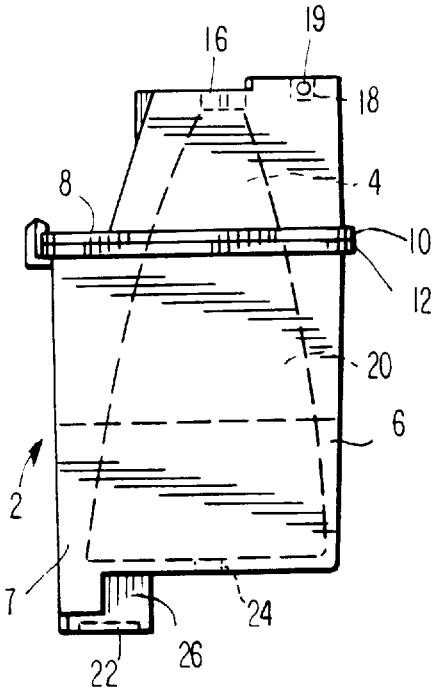
FIG. 1 is a front elevational view of a single chamber ink cartridge with which the present invention is used.
Figure 2:
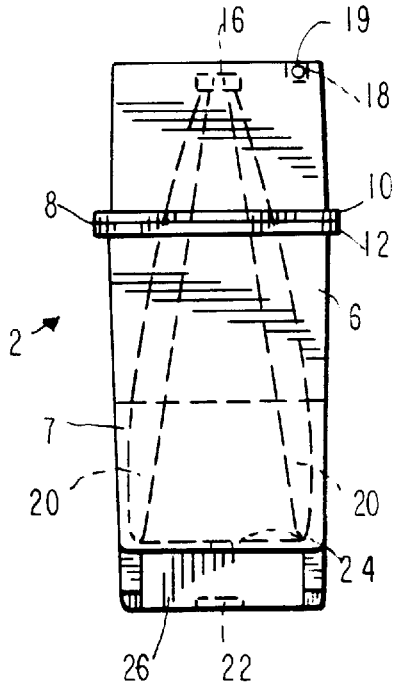
FIG. 2 is a right side elevational view of the single ink chamber cartridge shown in FIG. 1.
Figure 3:
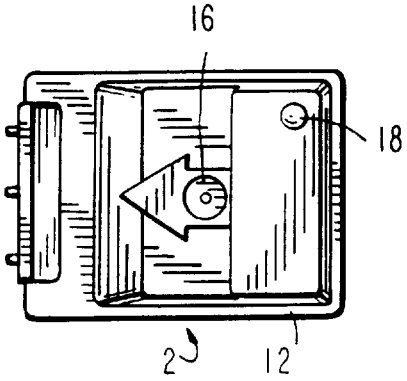
FIG. 3 is a plan view of the single ink chamber cartridge shown in FIG. 1.

There is shown in FIGS. 1 and 2 a plastic, single chamber ink cartridge 2 of the type sold by Hewlett-Packard under Model No. HP-51626A. Cartridge 2 includes an upper portion 4 and a connected lower portion 6. Ink 7 is contained within cartridge 2. A peripheral ridge 8 is formed by the juncture of border 10 at the bottom of upper portion 4 and border 12 at the top of lower portion 6.

The upper portion 4 includes an air priming hole 16 and an ink fill hole 18, which is sealed with an ink sealing ball 19, after filling with ink 7. Air priming hole 16 is connected to two inflatable air bags 20, so that when air is blown into air priming hole 16 the air bags 20 are inflated. The purpose of the air bags 20 is to create a slightly negative air pressure within the chamber formed by upper portion 4 and lower portion 6 to prevent the ink 7 from exiting through openings in the print head 22 of cartridge 2 and/or through an aspiration hole 24 at the bottom of cartridge 2. The cartridge also includes a thin metallic spring (not shown) on the outside of each air bag 20, for the purpose of exerting a squeezing force on the air bags, thereby assuring a negative air pressure within the ink chamber. A print head 22 is located at the bottom of extension 26 of lower portion 6. The aspiration hole 24 is part of a labyrinth system (not shown) located at the bottom of lower portion 6 and to the rear of extension 26. The purpose of the labyrinth system is to stabilize the air pressure within cartridge 2 when cartridge 2 is exposed to different external air pressures.

B. The Multiple Chamber Ink Cartridge

Figure 5:
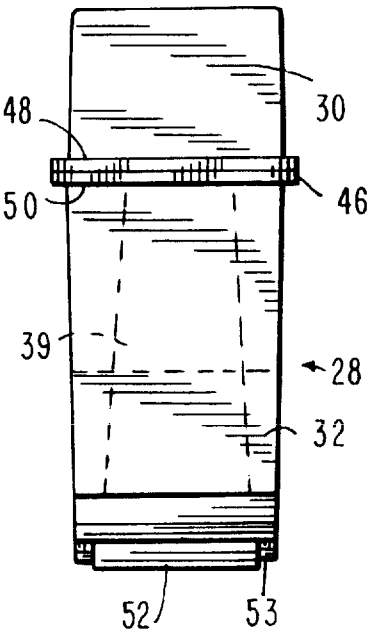
FIG. 5 is a right side elevational view of the three chamber cartridge shown in FIG. 4.
Figure 4:
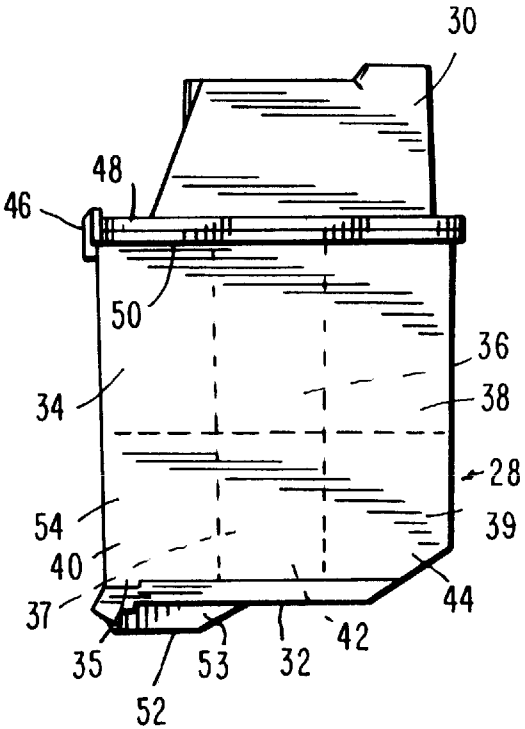
FIG. 4 is a front elevational view of a cartridge having three chambers with which the present invention is used.

There is shown in FIGS. 4 and 5 a plastic, multiple chamber ink cartridge 28 of the type sold by Hewlett Packard under Model No. HP-51625A. Cartridge 28, which is larger than single chamber ink cartridge 2 includes an upper portion 30 and a connected lower portion 32. Cartridge 28 includes three chambers 34, 36 and 38 which include different colored inks 40, 42 and 44, respectively. The color of the inks may, for example, be cyan, magenta and yellow. Each chamber includes a sponge for the efficient absorption of ink. Thus, chamber 34 includes sponge 35, chamber 36 includes sponge 37, and chamber 38 includes sponge 39. A peripheral ridge 46 is formed by the juncture of border 48 at the bottom of upper portion 30 and border 50 at the top of lower portion 32. A print head 52 is located at the bottom of extension 53 of cartridge 28.

C. Refilling Device and Station for Cartridges

The refilling device and station 54 includes a housing portion 56 and a cover portion 58 connected to the housing portion 56 by living hinge 60. As shown, for example, in FIGS. 8 and 9, the upper section of housing portion 56 comprises a guide 59 which consists of a front section 62, a rear section 64 and side sections 66. Front section 62 includes two inclined integral surfaces 68 and 70. Inclined surface 68 includes openings 72, 74 and 76, having screw threads therein, which correspond to chambers 34, 36 and 38 of cartridge 28, respectively. Housing portion 56 includes an inner wall portion 78 having a generally U-shaped depression 80 at the top thereof for providing clearance of cartridge 28. The distance from the bottom of the inside of housing portion 56 to the top portion of a ridge 81 on an inner side wall 83 of side section 66 (see FIG. 8) is substantially the same as the lower portion of cartridge 28. A first ledge 82 having a sealing pad 84 thereon is located inside housing portion 56. A second ledge 86 having a sealing pad 88 thereon is also located inside housing portion 56. Sealing pads 84 and 86 are formed of sponge-like material with an outer layer of non-water permeable film. An opening 90 in the bottom of the housing portion 56 is adapted for receiving an aspiration hole sealing plug 92. Housing portion 56 also includes opposite inner wall portions 94 of equal height. The height of inner wall portions 94 is slightly below the height of the lower portion 6 of cartridge 2.

The cover portion 58 of refilling device and station 54 includes angular shaped sides 96 integral with web sections 98 and 100. Web section 98 includes a U-shaped opening 102 at its edge and web section 100 includes a triangular-shaped opening 104. A rubber air priming hole sealing plug 106 is carried by web section 100. A screw 101 having a drill point 103 on the end thereof is adapted to be screwed into the opening 72, 74 or 76. The screw 101 has a wing portion 105 to enable the user to turn screw 101. The screw 101 includes a prong 107 and a post 109 including a concave spherical depression 111 which conforms to the diameter of ink sealing ball 19.

Figures 15, 16:
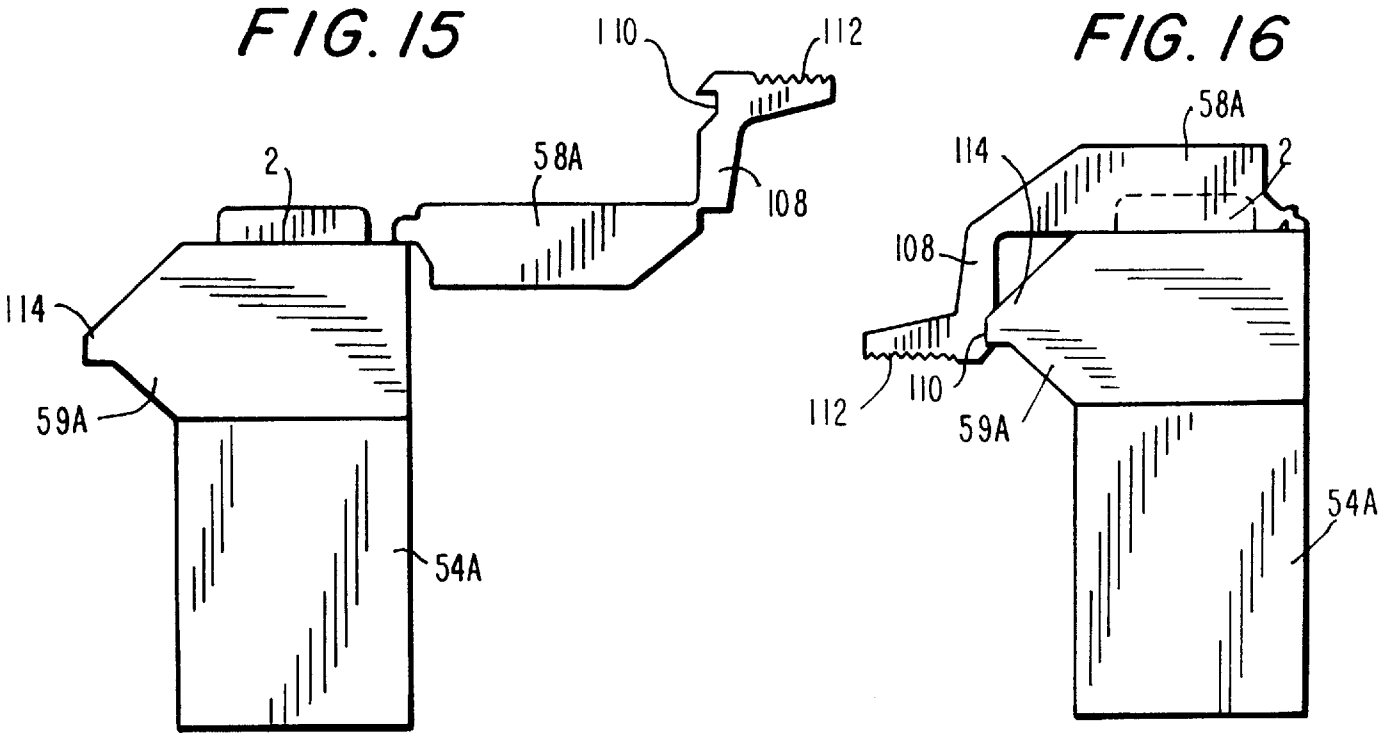
FIG. 15 is a right side schematic elevational view of another embodiment of the ink cartridge refilling device and station of the present invention, including a single chamber cartridge located therein, and wherein the ink cartridge refilling device and station cover is opened.
FIG. 16 is a right side schematic elevational view of the ink cartridge refilling device and station shown in FIG. 15 and wherein the ink cartridge refilling device and station cover are closed.

In FIGS. 15 and 16 there is shown a refilling device and station 54A which is substantially similar to the refilling device and station 54 with the exception of the means for clamping the cover portion 58A against the guide 59A. In the embodiment shown in FIGS. 15 and 16, there is shown therein a latch 108 on cover 58A, wherein latch 108 includes a locking surface 110 and serrated finger grooves 112.

D. The Gravity Feed Ink Bottle

Figure 6:
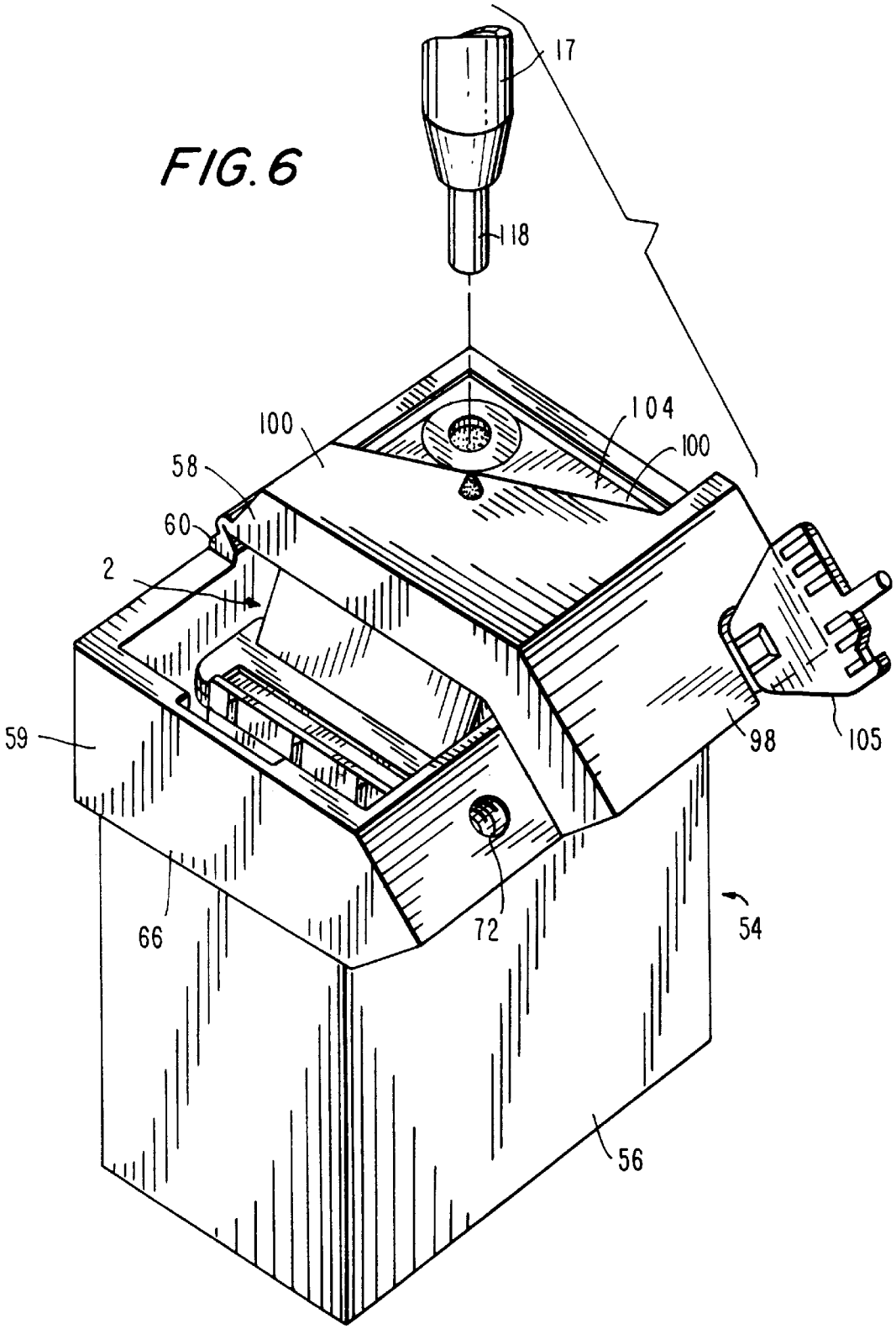
FIG. 6 is a perspective view of the combined refilling device and station with the cover closed.
Figure 17:
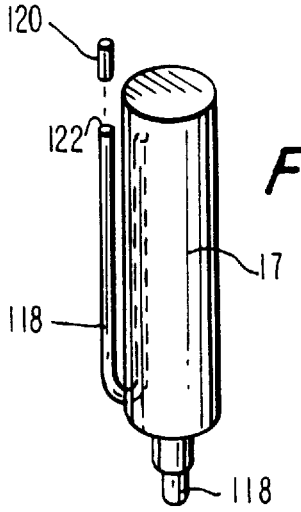
FIG. 17 is a perspective view of a first embodiment of the gravity feed ink bottle of the present invention.

The gravity feed ink bottle 17, which is partially illustrated in FIG. 6, is shown in full in FIG. 17. A conventional ink filling nozzle 118 is integral with ink bottle 17 and a U-shaped air breather tube 116 extends into ink bottle 17. A removable cap 120 is seated in opening 122 of air breather tube 116.

Figure 18:
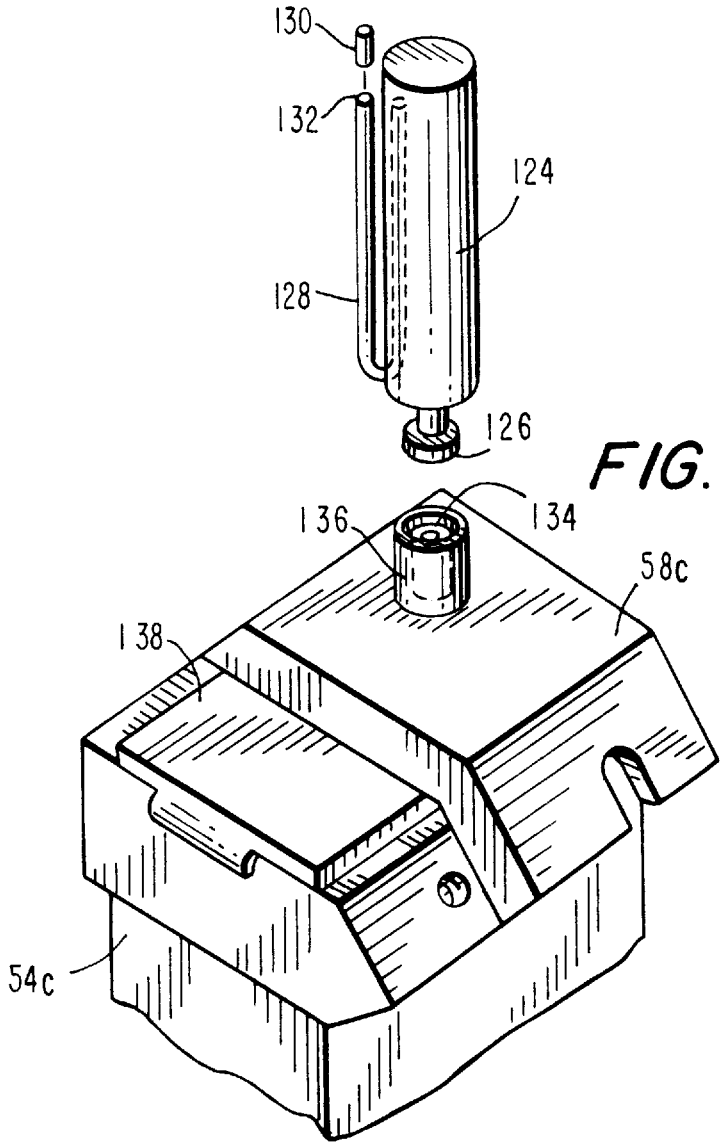
FIG. 18 is a perspective view of a second embodiment of the gravity feed ink bottle of the present invention and a partial perspective view of the ink cartridge refilling device and station with which the ink bottle is used, and wherein the covers of the ink cartridge refilling device and station are closed.

The gravity feed ink bottle 124 shown in FIG. 18 includes a rubber seal 126 which covers an opening at the bottom of gravity feed ink bottle 124. U-shaped air breather tube 128 extends into ink bottle 124 and a removable cap 130 is seated in opening 132 of air breather tube 128.

A refilling device and station 54C (see FIGS. 18 and 19) for refilling the single chamber cartridge 2 is generally similar to the previously described refilling device and station 54, with the exception that cover portion 58 of refilling device and station 54 has been modified and a second cover 138 has been added. More specifically, cover portion 58C of refilling device and station 54C includes a hypodermic tube 134 which is located in line with a fill tube 136. Second cover 138 pivotably connected to refilling device and station 54C includes an opening 140, through which fill tube 36 extends when the refilling device and station 54C is in use, and an air priming hole sealing plug 106C which serves the same function as the air priming hole sealing plug 106 of refilling device and station 54. Second cover 138 includes a latch 142 which is engageable with locking surface 144 on refilling device and station 54C.

E. Operation of the Refilling Device

Figure 7:
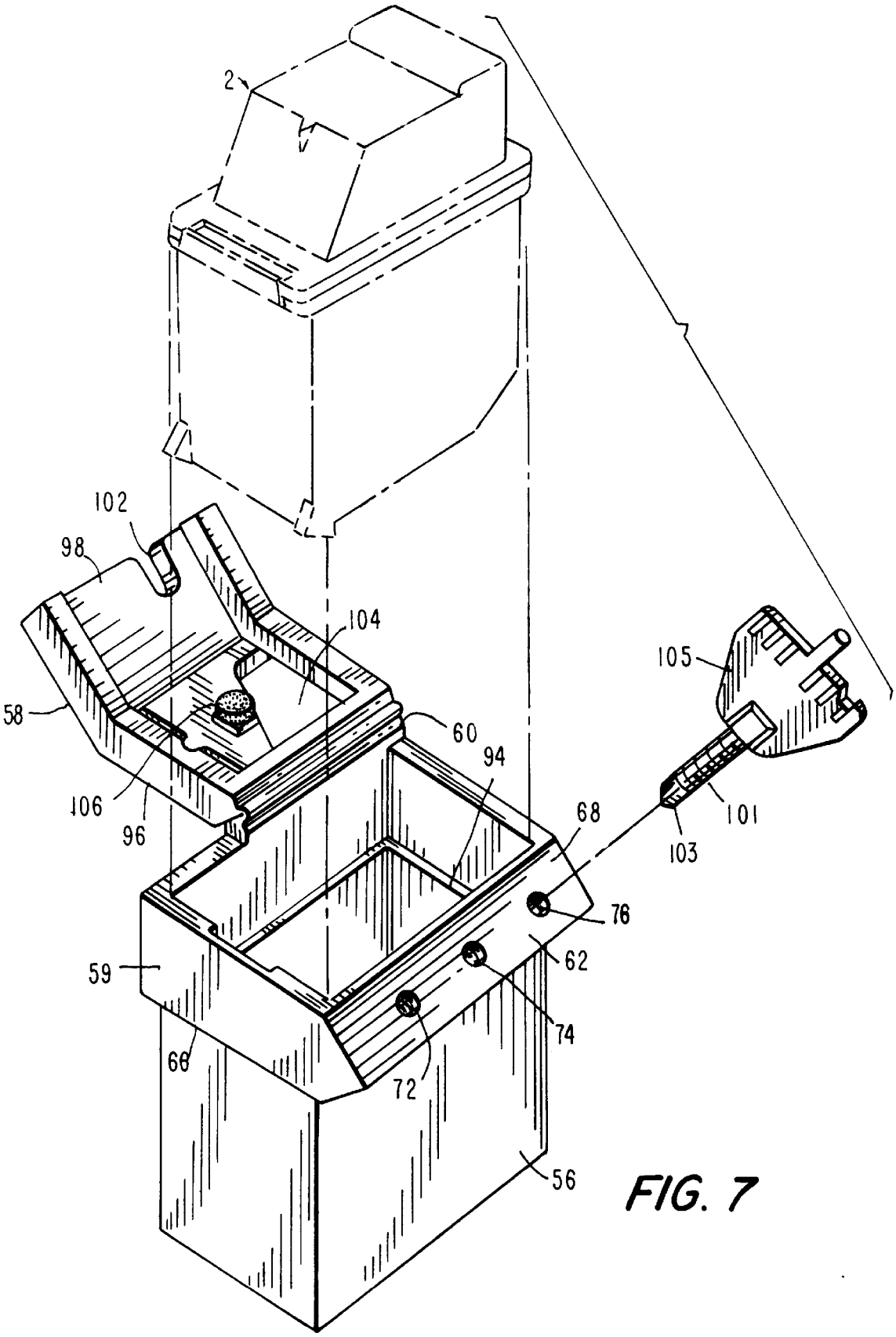
FIG. 7 is a perspective view of the combined refilling device and station with the cover opened.
Figure 9:
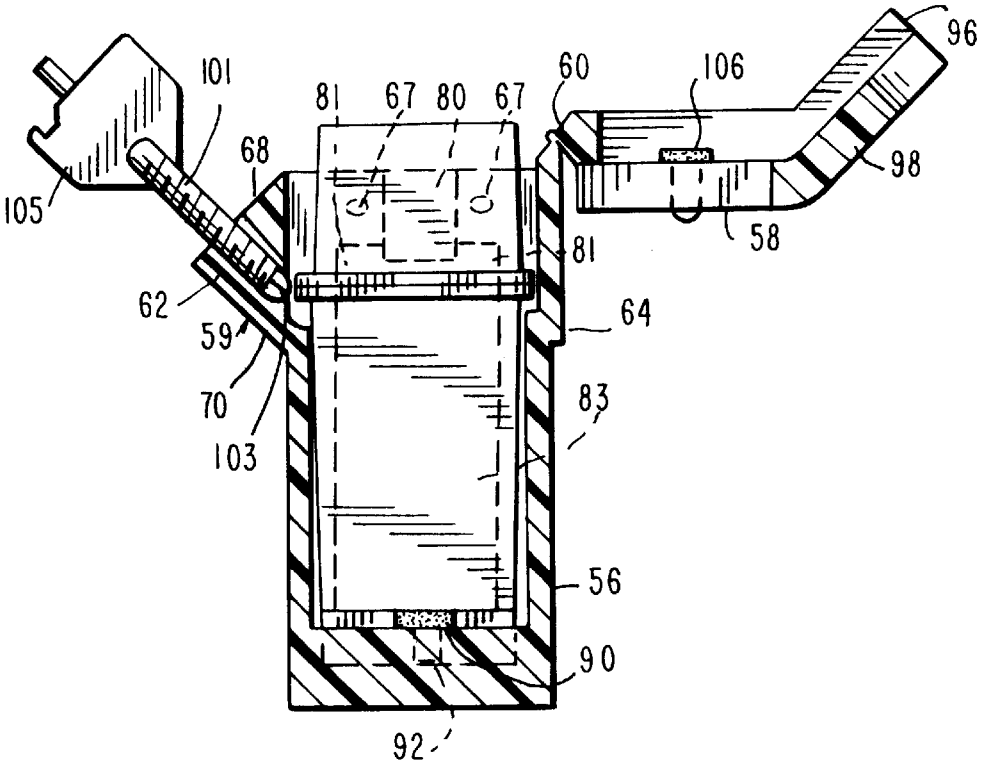
FIG. 9 is a right side elevational view of the ink cartridge refilling device and station of the present invention including a single chamber cartridge located therein and wherein the station cover is opened.
Figure 8:
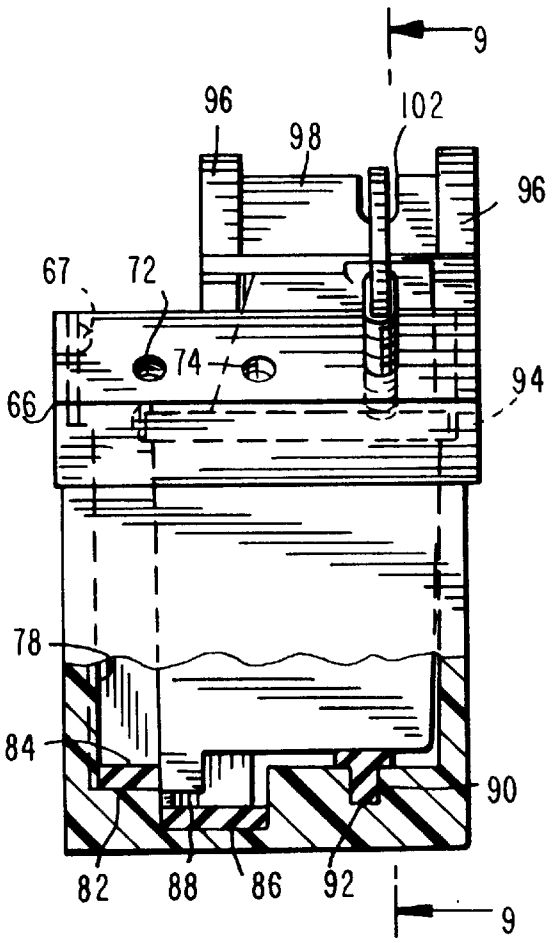
FIG. 8 is a front elevational view of the ink cartridge refilling device and station of the present invention including a single chamber cartridge located therein.
Figure 10:
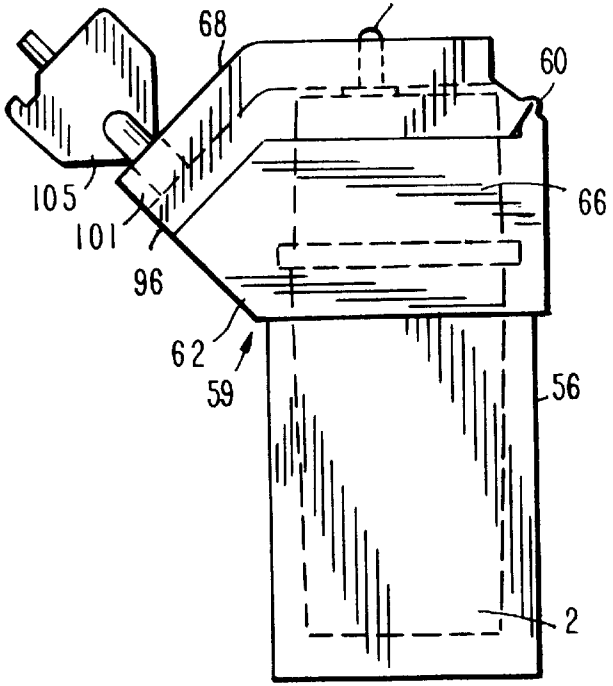
FIG. 10 is a right side elevational view of the ink cartridge refilling device and station of the present invention including a single chamber cartridge located therein and wherein the station cover is closed.

In order to refill the single chamber cartridge 2, it is placed in the refilling device and station 54 as shown in FIGS. 8 and 9. The print head 22 of cartridge 2 rests on sealing pad 88 preventing the ink 7 from exiting the print head 22 when the cartridge is being filled and also if the cartridge 2 is stored in the refilling device and station 54. Similarly, aspiration hole sealing plug 92 prevents ink 7 from exiting aspiration hole 24 in the bottom of cartridge 2 when the cartridge is being filled. To further secure cartridge 2 within the refilling device and station 54, the cover portion 58 is pivoted counterclockwise from the position shown in FIG. 9 to the position shown in FIG. 10. The screw 101 is screwed through U-shaped opening 102 of web section 98 into opening 76. As screw 101 continues to be screwed into opening 76, it clamps web section 98 against inclined surface 68 of housing portion 56 to further secure cartridge 2. In so doing, the rubber aspiration hole sealing plug 92 is compressed, and the sealing pad 88 is compressed against the rubber air priming hole plug 106, to effectively seal cartridge 2. The locking means disclosed in FIGS. 15 and 16 may also be used to secure the cover portion 58 against the guide 59. In this instance, cartridge 2 is placed in the refilling device and station 54A in the same manner as cartridge 2 is placed in the refilling device 54. To secure cartridge 2 within the refilling device and station 54A, the cover portion 58A is pivoted counterclockwise from the position shown in FIG. 15 to the position shown in FIG. 16. The locking surface 110 of latch 108 is locked in place on locking surface 114 of guide 59A. In this manner, the latch 108 and locking surface 114 in the FIGS. 15 and 16 embodiment perform a similar function to the wing screw 101 and opening 102 of guide 59 in the FIGS. 6 and 7 embodiment. At this juncture, the cartridge 2 is in position to be filled with ink or, if cartridge 2 already has ink therein, it may be stored in the refilling device and station 54 for use at a later time.

If it is desired to fill cartridge 2 with ink 7, the ink sealing ball 19 is pressed into cartridge lower portion 6 by post 109 to open ink fill hole 18 and ink is injected into ink fill hole 18 by, for example, a fill nozzle attached to a gravity fed reservoir bottle partially shown as 17 in FIG. 6 and fully shown in FIG. 17. It will be noted that the triangular-shaped opening 104 in web section 100 permits entry of a nozzle into ink fill hole 18. Upon the cartridge 2 being filled with ink, a rubber plug 113, such as a plug similar to aspiration hole sealing plug 92 (see FIG. 13), is inserted in ink fill hole 18. The triangular opening in web section 100 permits clearance of the user's fingers to enable insertion of the plug 113. The screw 101 is then unscrewed to enable cover portion 58 to be pivoted clockwise and cartridge 2 to be removed from the refilling device and station 54. To remove plug 113 to again refill cartridge 2, prong 107 of screw 101 is inserted under the flange of plug 113 to lift plug 113 (see FIG. 13).

To remove cartridge 2 from the refilling device and station 54A, the user's finger is placed under the serrated finger grooves 112 and cover portion 58A is pivoted clockwise to permit cartridge 2 to be removed from the refilling device and station 54A.

Figure 19:
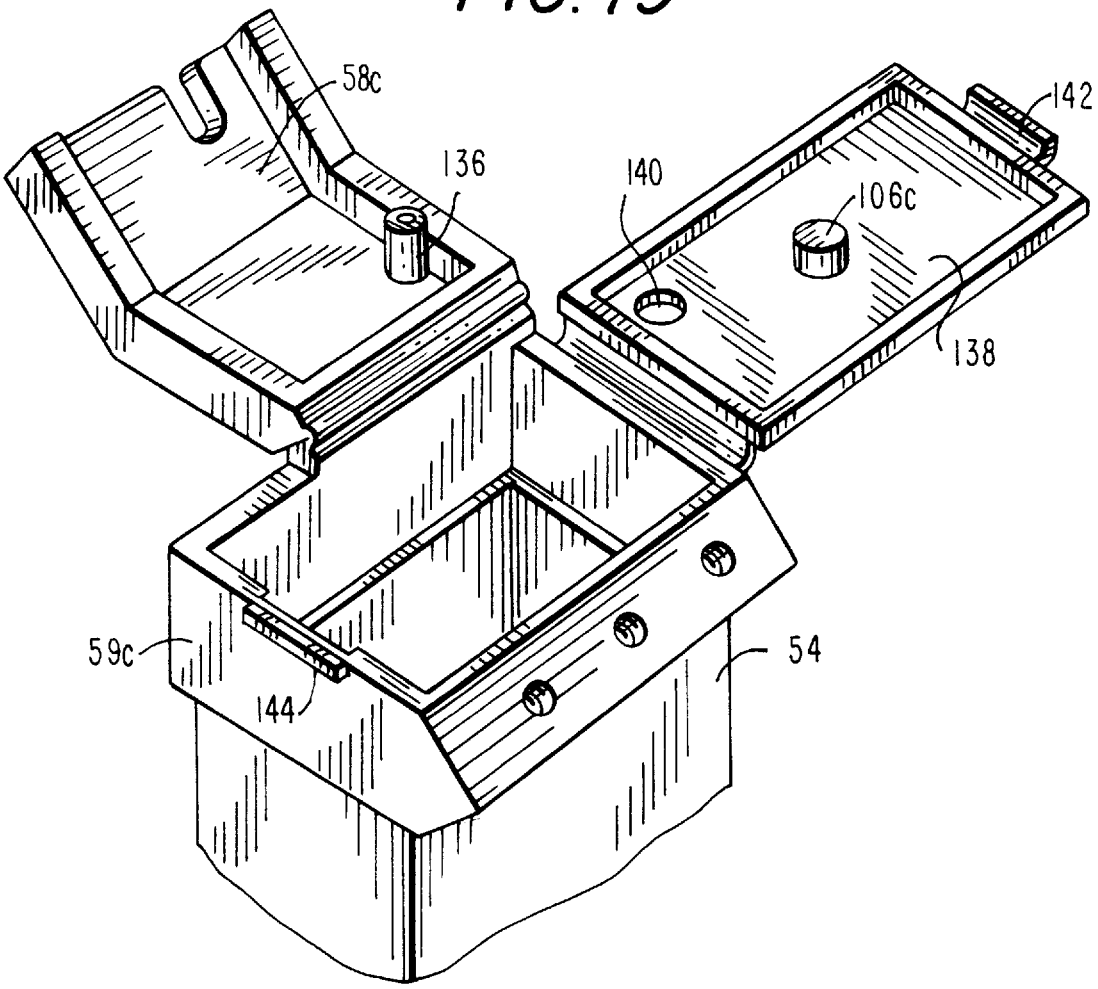
FIG. 19 is a partial perspective view of the ink cartridge refilling device and station shown in FIG. 18 and wherein the covers of the ink cartridge refilling device and station are opened.

For use of the gravity feed ink bottle 124 shown in FIG. 18, the cartridge 2 is placed in the ink cartridge refilling device and station 54C and the ink fill hole of cartridge 2 is opened. The second cover 138 is then pivoted counterclockwise (as seen in FIG. 19) so that latch 142 of second cover 138 is in engagement with the locking surface 114 of guide 59C of ink cartridge refilling device and station 54C. Next, cover 58C is pivoted clockwise (as seen in FIG. 19) so that it overlies second cover 138. Cover 58C may then be clamped to guide 59C by a wing screw in the same manner that cover 58 is clamped to guide 59. The rubber seal 126 of gravity feed ink bottle 124 is then pierced by hypodermic tube 134. The cap 130 is removed from opening 132 of U-shaped air breather tube 128 to cause the ink in ink bottle 124 to flow through fill tube 134 into cartridge 2. The advantage of the U-shaped air breather tube 128 (and U-shaped air breather tube 116 of ink bottle 7) is that it inhibits the tendency of the ink to flow from the bottle after the cartridge has been filled, even when the cap 130 is not in opening 132 of U-shaped air breather tube 128 and the bottle is in an upright position.

Figure 11:
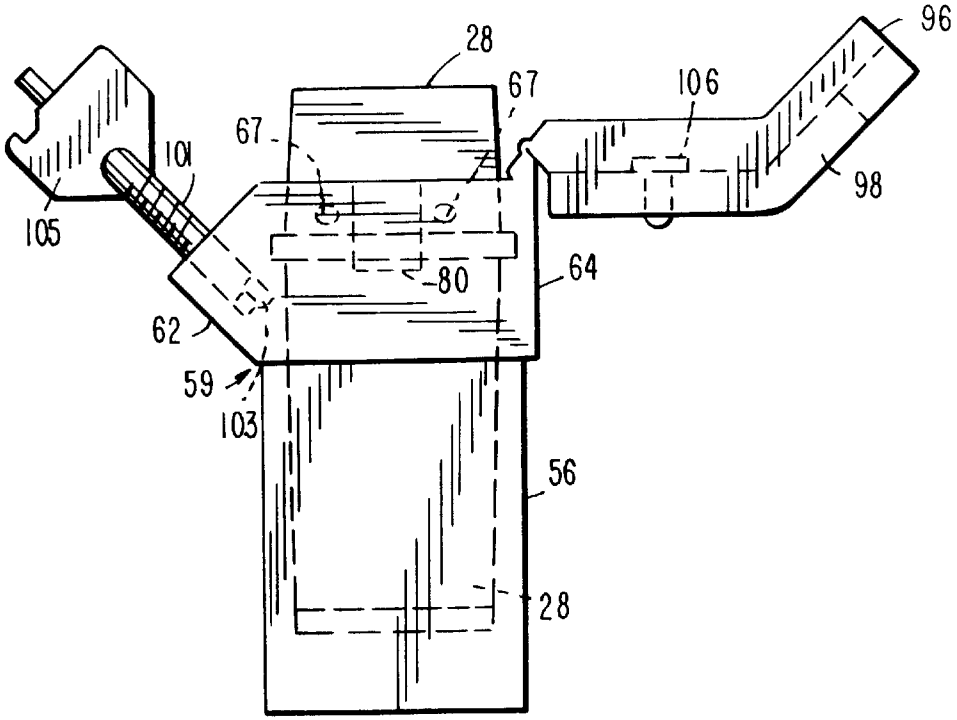
FIG. 11 is a right elevational view of the ink cartridge refilling device and station of the present invention including a three chamber cartridge located therein.

In order to refill multiple chamber cartridge 28, cartridge 28 is placed in the refilling device and station 54 as shown in FIG. 11. A portion of peripheral ridge 46 of cartridge 28 rests in depression 80 of inner wall portion 78. In this position, the print head 52 of cartridge 28 is supported on sealing pad 84 and the ink 40, 42 and 44 is prevented from exiting through the print head 52 when the cartridge 28 is being filled. Raised dimples 67 on side sections 66 of refill device exert a downward force on top of upper portion 30 of cartridge 28 to press print head 52 into contact with sealing pad 84. In this manner, the ink 40, 42 and 44 is prevented from leaking during refilling and/or from drying out in the print head 52 during long term storage. It is therefore unnecessary to further secure the cartridge 28 by means such as cover portion 58 of refilling device and station 54.

To fill cartridge 28 with ink, screw 101 is screwed into an opening 72, 74 or 76 of inclined surface 68 of refilling device and station 54. It is recalled that openings 72, 74 and 76 correspond to chambers 34, 36 and 38 in cartridge 28, respectively. The continued screwing of screw 101 causes drill tip 103 of the screw 101 to pierce the upper portion of cartridge 28 and make an opening in the associated cartridge chamber for insertion of ink. For example, screwing screw 101 into opening 72 will cause drill tip 103 to make an opening in cartridge chamber 34. The screw 101 is then unscrewed and ink 40 is injected into cartridge chamber 34 as, for example, by a conventional needle. In the same manner, screwing screw 101 into opening 74 causes drill tip 103 to make an opening in chamber 36, and screwing screw 101 into opening 76 causes drill tip 103 to make an opening in chamber 38. Ink 42 and 44 may then be injected into the openings in chambers 36 and 38, respectively.

It is seen that screw 101 enters the cartridge 28 at an angle. That permits a needle containing ink to be insertable in the cartridge 28 at the same angle, enabling the needle to be inserted near the bottom of sponges 35, 37 or 39 for permitting the efficient absorption of ink by the sponge. After the chambers are filled with ink, the fill holes are sealed with adhesive tape, either individually or the tape may be placed over all three holes. For subsequent refillings, the adhesive tape is removed for gaining access to the refilling holes. The cartridge 28 may then be removed from the refilling device and station 54 and used in a printer or it may remain in the refilling device and station 54 for storage.

Having thus described the invention, it will be apparent to those of skill in the art that various modifications can be made within the scope of the invention. For example, guide 58 of refilling device and station 54 may be made separate from housing portion 56.

What I claim is:

1. An ink cartridge refilling device for inserting ink in a first cartridge having multiple ink chambers and a second cartridge of different configuration having a single ink chamber, said device comprising a guide having an opening therein which surrounds a portion of said first cartridge and having at least one hole therein within which a screw having a drill tip thereon is located, whereby turning the screw causes the drill point to pierce the first cartridge and form a hole therein for insertion of ink;

a housing portion for said section cartridge; and hingeable cover means for securing said second cartridge in said housing.

2. An ink cartridge refilling device as recited in claim 1 wherein said first cartridge includes a sponge located in each chamber for enabling the efficient absorption of ink.

3. An ink cartridge refilling device as recited in claim 1 wherein said at least one hole in the guide is located on an inclined portion of said guide.

4. An ink cartridge refilling device as recited in claim 1 wherein said at least one hole is a tapped hole.

5. An ink cartridge refilling device as recited in claim 1 wherein the number of holes in said guide varies with the number of chambers in the first cartridge.

6. An ink cartridge refilling device as recited in claim 1 wherein the guide surrounds the sides of the first cartridge.

7. An ink cartridge refilling device as recited in claim 1 wherein the first cartridge is located in a housing portion of said device.

8. An ink cartridge refilling device as recited in claim 1 wherein the guide is integral with the housing portion.

9. An ink cartridge refilling device as recited in claim 1 wherein a wing screw connects the hingeable cover to said housing for securing the second cartridge in said housing.

10. An ink cartridge refilling device as recited in claim 1 wherein said cover includes a plug for sealing an air priming hole in said second cartridge.

11. An ink cartridge refilling device as set forth in claim 1 wherein said second cartridge includes a print head and wherein said housing portion includes a sealing pad for preventing ink from exiting the second cartridge through said print head.

12. An ink cartridge refilling device as set forth in claim 1 wherein said housing portion includes a plug for sealing an aspiration hole in said second cartridge.

13. An ink cartridge refilling device as set forth in claim 9 wherein said screw having a drill tip thereon includes a winged head to facilitate manual turning of the screw.

14. An ink cartridge refilling device for inserting ink in a cartridge having multiple chambers comprising a guide having an opening therein which surrounds a portion of the cartridge in snug fit relation, at least one hole in said guide within which a wing screw having a drill tip thereon is located, whereby turning the wing screw causes the drill point to pierce the cartridge and form a hole therein for insertion of ink.

15. An ink cartridge refilling device as recited in claim 14 wherein said cartridge includes a sponge located therein for enabling the efficient absorption of ink.

16. An ink cartridge refilling device as recited in claim 14 wherein said at least one hole in the guide is located on an inclined portion of said guide.

17. An ink cartridge refilling device as recited in claim 14 wherein said at least one hole is a tapped hole.

18. An ink cartridge refilling device as recited in claim 14 wherein the number of holes in said guide varies with the number of chambers in the cartridge.

19. An ink cartridge refilling device as recited in claim 14 wherein the guide surrounds the sides of the cartridge.

20. An ink cartridge refilling device as recited in claim 14 wherein the cartridge is located in a housing portion of said device.

21. An ink cartridge refilling device as recited in claim 20 wherein the guide is integral with the housing portion.

22. An ink cartridge refilling device for inserting ink in a cartridge having a single chamber comprising a housing portion for said cartridge and a hingeable cover means for securing said cartridge in said housing, and wherein a wing screw secures the hingeable cover to said housing for securing the cartridge in said housing.

23. An ink cartridge refilling device as recited in claim 22 wherein said cover includes a plug for sealing an air priming hole in said cartridge.

24. An ink cartridge refilling device as set forth in claim 22 wherein said cartridge includes a print head and wherein said housing portion includes a sealing pad for preventing ink from exiting the cartridge through said print head.

25. An ink cartridge refilling device as set forth in claim 22 wherein said housing portion includes a plug for sealing an aspiration hole in said cartridge.

26. An ink cartridge refilling device as set forth in claim 23 wherein said housing portion includes a hole therein within which a screw having a drill tip thereon is located.

27. An ink cartridge refilling device as set forth in claim 26 wherein said hole is a tapped hole.

28. An ink cartridge station for securing ink cartridges of two or more sizes so that said cartridges may be refilled and/or stored, comprising:

a housing in which the larger of said cartridges occupies substantially the entire volume of said housing and is provided with detent means to secure said cartridges within said housing and means on said housing for securing the smaller of said cartridges in said housing.

29. An ink cartridge station for securing cartridges of two or more sizes as recited in claim 28 wherein the means on said housing for securing the smaller of said cartridges is a hingeable cover connected to said housing.

30. An ink cartridge station for securing cartridges of two or more sizes as recited in claim 28 wherein a wing screw connects the hingeable cover to said housing for securing the smaller of said cartridges in said housing.

31. An ink cartridge station for securing cartridges of two or more sizes as recited in claim 28 wherein each said cartridge includes a print head and wherein said housing portion includes a sealing plug for each said print head for preventing ink from exiting the print head.

32. An ink cartridge station for securing cartridges of two or more sizes as recited in claim 28 wherein the larger of said cartridges has a peripheral ridge which is supported on an inner wall portion of said housing.

33. An ink cartridge station for securing cartridges of two or more sizes as recited in claim 28 wherein the smaller of said cartridges is supported in position by said sealing pads.

34. An ink cartridge station for securing cartridges of two or more sizes as recited in claim 28 wherein said housing portion includes a plug for sealing an aspiration hole in said cartridge.

35. An ink cartridge station for securing cartridges of two or more sizes as recited in claim 28 wherein the smaller of said cartridges is supported in position by said sealing plug.

36. An ink cartridge station for scouring cartridges of two or more sizes as recited in claim 28 wherein the smaller of said cartridges is supported in position by sealing pads and said sealing plug.

37. A combination screw having a drill tip thereon for piercing a hole in an ink jet cartridge containing a confined supply of ink and a wing portion integral with said screw.

38. A combination screw having a drill tip thereon as recited in claim 37 and further including a prong thereon for removing a rubber plug.

39. A combination screw having a drill tip thereon as recited in claim 37 and further including a post for removing an ink sealing plug.

40. A gravity ink feed bottle for refilling an ink jet cartridge, said bottle including ink therein, a nozzle through which the ink exists, a U-shaped air breather tube having one arm on the outside of said bottle and the other arm inside said bottle, and a removable cap located in an opening in the arm of the air breather tube outside of said bottle.

* * * * *